United States Patent [19]

Kurisu et al.

[11] Patent Number: 4,575,734

[45] Date of Patent: Mar. 11, 1986

[54] THERMOSENSITIVE IMAGE TRANSFER MEDIUM

[75] Inventors: Norio Kurisu, Numazu; Keishi Kubo, Yokohama, both of Japan

[73] Assignee: Ricoh Company, Ltd., Tokyo, Japan

[21] Appl. No.: 517,874

[22] Filed: Jul. 27, 1983

[30] Foreign Application Priority Data

Aug. 19, 1982 [JP] Japan ..... 57-143668
Aug. 19, 1982 [JP] Japan ..... 57-143669

[51] Int. Cl.[4] ..... B41M 5/22

[52] U.S. Cl. ..... 346/208; 346/207; 346/209; 427/150; 427/151

[58] Field of Search ..... 346/208, 209, 207, 216, 346/217, 225; 427/150, 151, 152

[56] References Cited

U.S. PATENT DOCUMENTS 4,352,860 10/1982 Kubo et al. ..... 346/209
4,401,721 8/1983 Hida ..... 428/913

FOREIGN PATENT DOCUMENTS 3119053 2/1982 Fed. Rep. of Germany ..... 346/209
6169087 12/1981 Japan ..... 346/209
0089995 6/1982 Japan ..... 346/226
0117998 7/1982 Japan ..... 346/209
0182483 11/1982 Japan ..... 346/209
0203589 12/1982 Japan ..... 346/209

*Primary Examiner*—Bruce H. Hess
*Attorney, Agent, or Firm*—Flynn, Thiel, Boutell & Tanis

[57] ABSTRACT

A thermosensitive image transfer medium consisting of (i) an image transfer sheet having an image transfer layer consisting essentially of a leuco dye, and (ii) an acceptor sheet having an acceptor layer consisting essentially of a coloring agent with a melting point of not higher than 200° C., which induces color formation in the leuco dye, and, of the image transfer layer and the acceptor layer, at least one layer containing a particular image transfer auxiliary agent for facilitating image formation on the acceptor sheet.

17 Claims, No Drawings

THERMOSENSITIVE IMAGE TRANSFER MEDIUM

BACKGROUND OF THE INVENTION

The present invention relates to a thermosensitive image transfer medium which is capable of yielding images with high and uniform image density even if image transfer is done multiple times. More particularly, it relates to a thermosensitive image transfer medium consisting of (i) an image transfer sheet having an image transfer layer consisting essentially of a leuco dye, and (ii) an acceptor sheet having an acceptor layer consisting essentially of a coloring agent with a melting point of not higher than 200° C., which induces color formation in the leuco dye, and, of the image transfer layer and the acceptor layer, at least one layer containing a particular image transfer auxiliary agent for facilitating image transfer and image formation.

Conventionally, there are known several thermosensitive image transfer mediums. For example, a thermosensitive image transfer medium consisting of (i) an image transfer sheet comprising a thermal-sublimation-type dye layer formed on a support material and (ii) an acceptor sheet capable of accepting the sublimated dye images from the thermal-sublimation-type dye layer of the image transfer sheet when thermal printing is performed on the backside of the image transfer sheet.

Another conventional thermosensitive image transfer medium consists of (i) an image transfer sheet comprising an image transfer layer formed on a support material, which image transfer layer comprises a thermo-fusible material and a pigment or a dye, and (ii) an acceptor sheet.

The former thermosensitive image transfer material has the shortcomings that the dye images on the acceptor sheet are poor in preservability because of the use of the thermal-sublimation-type dye and, therefore an overcoating must be provided on the transferred images.

In the case of the latter thermosensitive image transfer medium, the image transfer layer contains a pigment or a dye dispersed in the thermo-fusible material. In this thermosensitive image transfer medium, if a large quantity of the pigment is contained in the image transfer layer in an attempt of obtaining images with high density, the image transfer ratio decreases. The result is that it becomes difficult to obtain images with high density. If a large quantity of the thermo-fusible material is contained in the image transfer layer in order to increase the thermosensitivity, a large quantity of the thermo-fusible material is transferred from the transfer sheet to the acceptor sheet and, as a result, it becomes difficult to smoothly peel the transfer sheet off the acceptor sheet, and line images on the acceptor sheet become unclear.

In addition to the above-described conventional thermosensitive image transfer mediums, a further thermal-printing-type thermosensitive image transfer medium is known, in which materials which react with each other to form a color upon application of heat thereto are supported separately in the form of two layers, each layer on a different support material, and thermal printing is performed by bringing the two layers into close contact with each other. In thermosensitive image transfer mediums of this type, the coloring reaction does not occur sufficiently if the image transfer layer is merely transferred to the acceptor layer by bringing them into contact with each other, thus yielding images with low image density. If thermal printing were performed at high temperatures, with application of heat for a long period of time in order to allow the coloring reaction to take place sufficiently, images with high density could be obtained on the acceptor sheet. However, the coloring reaction also takes place on the image transfer sheet at the same time. In other words, image formation occurs on both the acceptor sheet and the image transfer sheet.

SUMMARY OF THE INVENTION

It is therefore an object of the present invention to provide a thermosensitive image transfer medium with higher sensitivity capable of yielding images with higher image density, in comparison with the above-described conventional thermosensitive image transfer mediums, which thermosensitive image transfer medium according to the present invention can provide images with uniform image density even if it is used for multiple image transfers, with a small amount of a leuco dye component being transferred from the image transfer layer to the acceptor layer of the medium in each image transfer step.

This object of the present invention can be attained by a thermosensitive image transfer medium consisting of (i) an image transfer sheet having an image transfer layer consisting essentially of a leuco dye, and (ii) an acceptor sheet having an acceptor layer consisting essentially of a coloring agent with a melting point of not higher than 200° C., which induces color formation in the leuco dye, and, of the image transfer layer and the acceptor layer, at least one layer containing a particular image transfer auxiliary agent, which is a key feature of the present invention.

DETAILED DESCRIPTION OF THE PREFERRED EMBODIMENTS

The thermosensitive image transfer medium according to the present invention consists of a transfer sheet having a image transfer layer comprising as the main component a leuco dye, and an acceptor sheet having an acceptor layer comprising as the main component a coloring agent which induces color formation in the leuco dye, with the image transfer layer and/or the acceptor layer containing at least one of the following image transfer auxiliary agents for facilitating image transfer and image formation:

(1) N-substituted acid amides of the formula (I)

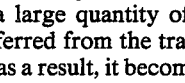

$$R^1NHCOR^2 \quad (I)$$

wherein $R^1$ represents an alkyl group having 10 to 30 carbon atoms; and $R^2$ represents an alkyl group having 1 to 30 carbon atoms.

(2) N-substituted acid amides of the formula (II)

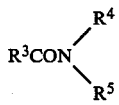

$$R^3CON\begin{matrix} R^4 \\ R^5 \end{matrix} \quad (II)$$

wherein $R^3$ represents an alkyl group having 10 to 30 carbon atoms; and $R^4$ and $R^5$ individually represent hydrogen or a lower alkyl group.

(3) N-substituted acid amides of the formula (III)

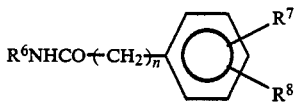

(III)

wherein $R^6$ represents an alkyl group having 1 to 30 carbon atoms; $R^7$ and $R^8$ individually represent hydrogen, halogen, a lower alkyl group or a lower alkoxy group; and n is an integer of 0 or 1.

(4) N-substituted acid amides of the formula (IV)

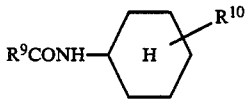

(IV)

wherein $R^9$ represents an alkyl group having 1 to 30 carbon atoms, or a substituted or unsubstituted aryl group; which aryl group is preferably phenyl and $R^{10}$ represents hydrogen, halogen or a lower alkyl group.

(5) N-substituted acid amides of the formula (V)

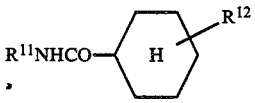

(V)

wherein $R^{11}$ represents an alkyl group or alkenyl group having 1 to 30 carbon atoms; and $R^{12}$ represents hydrogen, halogen or a lower alkyl group.

In the above formulas, as the lower alkyl group, an alkyl group having 1 to 6 carbon atoms is included. As the halogen, chlorine, bromine, iodine and fluorine are included. As the substituted aryl group in the formula, phenyl groups having substituents, such as an alkyl group, an alkoxy group, an acyloxy group or halogen, are included.

(6) Esters of the formula (VI)

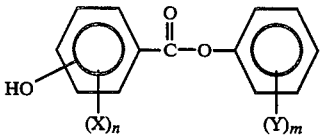

(VI)

wherein X represents halogen and Y represents halogen, propenyl, aralkyl group or alkoxy group having 1 to 30 carbon atoms, a substituted or unsubstituted aryl group or an aralkyl group, a substituted or unsubstituted aryloxy or aralkyloxy group, a carboxyl group or a hydroxyl group; n is an integer of 0, 1, 2 or 3; and m is an integer of 1, 2 or 3.

(7) Esters of the formula (VII)

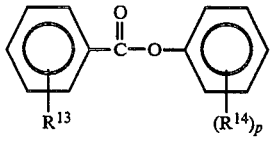

(VII)

wherein $R^{13}$ represents hydrogen, an alkyl group or alkoxy group having 1 to 30 carbon atoms, halogen, a nitro group, a nitrile group, an acyloxy group, a substituted or unsubstituted aryl group or aralkyl group, or a substituted or unsubstituted aryloxy or aralkyloxy group; $R^{14}$ represents hydrogen, an alkyl group or alkoxy group having 1 to 30 carbon atoms, halogen, a nitro group, a nitrile group, an acyloxy group, a substituted or unsubstituted aryl group or aralkyl group, a substituted or unsubstituted aryloxy group or aralkyloxy group, or an acyl group, and P is an integer of 1, 2 or 3.

(8) Esters of the formula (VIII)

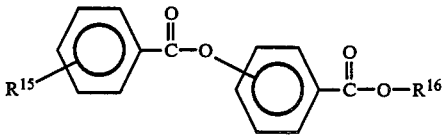

(VIII)

wherein $R^{15}$ represents hydrogen, an alkyl group or alkoxy group having 1 to 30 carbon atoms or halogen; and $R^{16}$ represents an alkyl group or alkenyl group having 1 to 30 carbon atoms, or a substituted or unsubstituted aryl group or aralkyl group.

In the above formula, as the halogen, chlorine, bromine, iodine and fluorine are included. As the substituted aryl group, phenyl groups having a substituent, such as an alkyl group, an alkoxy group, an acyloxy group or halogen, are included. As the acyloxy group, an acetoxy group and a substituted or unsubstituted benzoyloxy group are included. As the aralkyl group, a benzyl group and a phenethyl group are included. As the aryloxy group, a phenoxy group and a tolyloxy group are included. As the aralkyloxy group, a substituted or unsubstituted benzyloxy group and a phenethyloxy group are included. As the acyl group, a formyl group, an acetyl group and a substituted or unsubstituted benzoyl group or toluyl group are included.

In the thermosensitive image transfer medium according to the present invention, image formation is performed by superimposing the acceptor sheet on the image transfer sheet in such a manner that the acceptor layer of the acceptor sheet comes into close contact with the image transfer layer (i.e. a dye layer) of the image transfer sheet, and thermal printing is performed on the backside of the image transfer sheet or on the backside of the acceptor sheet, whereby images can be formed on the surface of the acceptor layer of the acceptor sheet.

When heat is applied, with the image transfer layer placed in close contact with the acceptor layer, part of the dye contained in the image transfer layer is transferred therefrom to the acceptor layer through the fused coloring agent contained in the acceptor layer. Therefore, by using the same image transfer sheet, with successive replacement of the acceptor sheet, a number of copies which bear images with high density can be obtained.

As mentioned previously, the key feature of the present invention is that the image transfer layer of the image transfer sheet or the acceptor layer of the acceptor sheet or both of them contain at least one of the image transfer auxiliary agents represented by the general formulas (I) through (VIII). By the addition of such image transfer auxiliary agent to the image transfer layer and/or to the acceptor layer, the reaction of the leuco dye with the coloring agent is facilitated, when the image transfer layer is brought into contact with the acceptor layer under application of heat thereto and the leuco dye is transferred from the image transfer layer to the acceptor layer, so that clear images with high density can be obtained.

More specifically, the image transfer auxiliary agents have the following functions:

(1) In the presence of the image transfer auxiliary agent, the melting point of the leuco dye is lowered, and as a matter of course, the melting point of the image transfer auxiliary agent itself is lowered, so that the leuco dye is melted in the fused image transfer auxiliary agent. As a result, the melting point of the image transfer layer is lowered.

(2) In the presence of the image transfer auxiliary agent, the melting point of the coloring agent is lowered because they constitute a eutectic mixture.

(3) In practice, the above described two phenomenona (1) and (2) take place at the same time and the melting points of the components contributing to this coloring reaction are lowered as a whole.

As mentioned previously, in the present invention, the image transfer auxiliary agent can be contained in the image transfer layer or in the acceptor layer or in both of them. However, it is preferable to add the image transfer agent at least to the image transfer layer, in an amount ranging from 0.1 part by weight to 50 parts by weight with respect to 1 part by weight of the leuco dye.

Specific examples of the image transfer auxiliary agents for use in the present invention are as follows:

N-substituted acid amides of the previously described formula (I) or of the formula (II), for example:

Decylacetamide,
decylpropionamide,
undecylacetamide,
undecylpropionamide,
laurylacetamide,
laurylpropionamide,
tridecylacetamide,
tridecylpropionamide,
myristylacetamide,
myristylpropionamide,
pentadecylacetamide,
pentadecylpropionamide,
palmitylacetamide,
palmitylpropionamide,
palmitylbutylamide,
heptylacetamide,
heptylpropionamide,
stearylacetamide,
stearylpropionamide,
stearylbutylamide,
stearylvaleramide,
stearylcapronamide,
stearylpalmitamide,
stearylpalmitamide,
stearylpalmitamide,
nonadecylacetamide,
nonadecylpropionamide,
behenylacetamide,
behenylpropionamide,
behenylstearamide,
undecanoic acid methylamide,
undecanoic acid ethylamide,
lauric acid methylamide,
lauric acid ethylamide,
tridecanoic acid methylamide,
tridecanoic acid ethylamide,
myristic acid methylamide,
myristic acid ethylamide,
pentadecanoic acid methylamide,
pentadecanoic acid ethylamide,
palmitic acid methylamide,
palmitic acid dimethylamide,
palmitic acid butylamide,
stearic acid methylamide,
stearic acid ethylamide,
stearic acid propylamide,
stearic acid butylamide,
stearic acid dimethylamide,
stearic acid diethylamide,
stearic acid dibutylamide,
nonadecanoic acid methylamide,
nonadecanoic acid ethylamide,
behenic acid methylamide,
oleic acid methylamide, and
oleic acid ethylamide.

N-substituted acid amides of the formula (III), for example:

N-stearylbenzamide,
N-palmityl-2-chlorobenzamide,
N-stearyl-2-methoxybenzamide,
N-stearyl-4-methylbenzamide,
N-palmityl-2,4-dimethylbenzamide,
N-behenylbenzamide,
N-behenyl-2-methylbenzamide,
N-stearylphenylacetylamide, and
N-behenylphenylacetylamide.

N-substituted acid amides of the formula (IV) or of the formula (V), for example:

N-cyclohexylacetamide,
N-cyclohexylpropionamide,
N-cyclohexylstearic acid amide,
N-cyclohexylbenzamide,
N-cyclohexyl-2-methylbenzamide,
N-cyclohexyl-2-chlorobenzamide,
N-cyclohexyl-2,4-dimethylbenzamide,
N-cyclohexylpalmitic acid amide,
N-(2-chlorohexyl)palmitic acid amide,
N-(2-methylcyclohexyl)stearic acid amide, and
N-stearylhexahydrobenzamide.

Esters of the formula (VI), for example:

4-hydroxybenzoic acid phenyl ester,
4-hydroxybenzoic acid (2-methoxyphenyl) ester,
4-hydroxybenzoic acid (2-methoxy-4-methylphenyl) ester,
4-hydroxybenzoic acid (3,5-dioxyphenyl) ester,
3-hydroxybenzoic acid (4-carboxyphenyl) ester,
4-hydroxybenzoic acid (4-butoxyphenyl) ester,
4-hydroxybenzoic acid (4-chlorophenyl) ester,
salicylic acid (2-chlorophenyl) ester,
salicylic acid (4-chlorophenyl) ester,
salicylic acid (2,4-dichlorophenyl) ester,
salicylic acid (2,6-dichlorophenyl) ester,
salicylic acid (2,4,6-trichlorophenyl) ester,
salicylic acid (2-bromophenyl) ester,
salicylic acid (4-bromophenyl) ester,
salicylic acid (2,4-dibromophenyl) ester,
salicylic acid (2,6-dibromophenyl) ester,
salicylic acid (2,4,6-tribromophenyl) ester,
salicylic acid (3-methylphenyl) ester,
salicylic acid (2,4-dimethylphenyl) ester,
salicylic acid (4-tert-butylphenyl) ester,
salicylic acid (4-tert-amylphenyl) ester,
salicylic acid (2-methoxyphenyl) ester,
salicylic acid (2-ethoxyphenyl) ester,
salicylic acid (3-methoxyphenyl) ester,
salicylic acid (4-hydroxyphenyl) ester, salicylic acid (4-benzylphenyl) ester,
salicylic acid (4-benzoylphenyl) ester,
salicylic acid (2-methoxy-4-arylphenyl) ester,
salicylic acid (α-naphthyl) ester,
salicylic acid (β-naphthyl) ester,
salicylic acid (4-chloro-3-methylphenyl) ester,
salicylic acid (3-hydroxyphenyl) ester,
salicylic acid (4-propenylphenyl) ester,
5-chlorosalicylic acid (3-methylphenyl) ester, and
3,5-dichlorosalicylic acid (2-methoxyphenyl) ester.

Esters of the formula (VII), for example:
Benzoic acid phenyl ester,
benzoic acid-4-methylphenyl ester,
benzoic acid-2,4-dichlorophenyl ester,
benzoic acid-2,4,6-trichlorophenyl ester,
benzoic acid-2-methyl-4-chlorophenyl ester,
benzoic acid-3-bromophenyl ester,
benzoic acid-2,4-dibromophenyl ester,
benzoic acid-3-iodophenyl ester,
benzoic acid-3-nitrophenyl ester,
benzoic acid-4-methyl-2,6-dichlorophenyl ester,
benzoic acid-4-isopropylphenyl ester,
benzoic acid-4-t-butylphenyl ester,
benzoic acid-4-benzylphenyl ester,
benzoic acid-4-(1-naphthyl)phenyl ester,
benzoic acid-2-benzoyloxyphenyl ester,
benzoic acid-4-(2-methyl)diphenyl ester,
benzoic acid-2-phenylethyloxyphenyl ester,
benzoic acid-2-acetoxyphenyl ester,
benzoic acid-4-methoxyphenyl ester,
benzoic acid-4-(4-methyl)phenoxyphenyl ester,
4-methylbenzoic acid phenyl ester,
4-methoxybenzoic acid phenyl ester,
4-phenoxybenzoic acid phenyl ester,
4-acetoxybenzoic acid phenyl ester,
4-methoxybenzoic acid-4'-methoxyphenyl ester,
2-acetoxybenzoic acid phenyl ester,
2-benzoyloxybenzoic acid phenyl ester,
2-nitrobenzoic acid-4-methylphenyl ester,
4-nitrobenzoic acid-4-methylphenyl ester,
4-benzoyloxybenzophenone, and
2-benzoyloxy-4'-methylbenzophenone.

Esters of the formula (VIII), for example:
4-benzoyloxybenzoic acid methyl ester,
4-benzoyloxybenzoic acid ethyl ester,
4-benzoyloxybenzoic acid-n-propyl ester,
4-benzoyloxybenzoic acid benzyl ester,
4-benzoyloxybenzoic acid phenyl ester,
2-benzoyloxybenzoic acid phenyl ester,
4-(4'-methylbenzoyloxy) benzoic acid ethyl ester,
4-(4'-methoxybenzoyloxy) benzoic acid ethyl ester,
4-(4'-chlorobenzoyloxy) benzoic acid ethyl ester.

The image transfer sheet for use in the present invention comprises (i) a support material made of, for example, paper, synthetic paper, plastic film, and (ii) the image transfer layer consisting essentially of a leuco dye formed on the support material.

As the leuco dye for use in the image transfer layer, conventional leuco dyes for use in pressure-sensitive paper and heat-sensitive paper can be employed, for example, triphenylmethane-type leuco dyes, fluoran-type leuco dyes, phenothiazine-type leuco dyes, auramine-type leuco dyes and spiropyran-type leuco dyes. Specific examples of these leuco dyes are as follows:
3,3-bis(p-dimethylaminophenyl)-phthalide,
3,3-bis(p-dimethylaminophenyl)-6-dimethylaminophthalide (or Crystal Violet Lactone),
3,3-bis(p-dimethylaminophenyl)-6-diethylaminophthalide,
3,3-bis(p-dimethylaminophenyl)-6-chlorophthalide,
3,3-bis(p-dibutylaminophenyl)-phthalide
3-cyclohexylamino-6-chlorofluoran,
3-(N,N-diethylamino)-5-methyl-7-(N,N-dibenzylamino) fluoran,
3-dimethylamino-5,7-dimethylfluoran,
3-diethylamino-7-methylfluoran,
3-diethylamino-7,8-benzofluoran,
3-diethylamino-6-methyl-7-chlorofluoran,
3-pyrrolidino-6-methyl-7-anilinofluoran,
2-{N-(3'-trifluoromethylphenyl) amino}-6-diethylaminofluoran,
2-{3,6-bis(diethylamino)-9-(o-chloroanilino) xanthylbenzoic acid lactam},
3-diethylamino-7-(o-chloroanilino) fluoran,
3-dibutylamino-7-(o-chloroanilino) fluoran,
3-N-methyl-N-amylamino-6-methyl-7-anilinofluoran,
3-N-methyl-N-cyclohexylamino-6-methyl-7-anilinofluoran,
3-(2'-hydroxy-4'-dimethylaminophenyl)-3-(2'-methoxy-5'-chlorophenyl) phthalide,
3-(2'-hydroxy-4'-dimethylaminophenyl)-3-(2'-methoxy-5'-nitrophenyl) phthalide,
3-(2'-hydroxy-4'-diethylaminophenyl)-3-(2'-methoxy-5'-methylphenyl) phthalide, and
3-(2'-methoxy-4'-dimethylaminophenyl)-3-(2'-hydroxy-4'-chloro-5'-methylphenyl) phthalide.

In the present invention, the leuco dye is usually used in an amount ranging from 0.3 g/m$^2$ to 50 g/m$^2$, preferably in the range of about 0.5 g/m$^2$ to about 30 g/m$^2$, on the support material.

The acceptor sheet for use in the present invention consists of a support material made of, for example, paper, synthetic paper or plastic film, and the acceptor layer formed on the support material. The acceptor layer contains a coloring agent which induces color formation in the leuco dye. As the coloring agent, electron acceptor materials, for instance, phenolic materials, organic acids, salts and esters of organic acids can be employed. For practical use, coloring agents with a melting point of not higher than 200° C. are preferable.

Specific examples of the coloring agents for use in the present invention are as follows:

| | Melting Point (°C.) |
|---|---|
| 4-tert-butylphenol | 98 |
| 4-hydroxydiphenyl ether | 84 |
| 1-naphthol | 98 |
| 2-naphthol | 121 |
| methyl-4-hydroxybenzoate | 131 |
| 4-hydroxyacetophenone | 109 |
| 2,2'-dihydroxydiphenyl ether | 79 |
| 4-phenylphenol | 166 |
| 4-tert-octylcatechol | 109 |
| 2,2'-dihydroxydiphenyl | 103 |
| 4,4'-methylenebisphenol | 160 |
| 2,2'-methylenebis (4-chlorophenol) | 164 |
| 2,2'-methylenebis(4-methyl-6-tert-butylphenol) | 125 |
| 4,4'-isopropylidenediphenol | 156 |
| 4,4'-isopropylidenebis(2-chlorophenol) | 90 |
| 4,4'-isopropylidenebis(2,6-dibromophenol) | 172 |
| 4,4'-isopropylidenebis(2-tert-butylphenol) | 110 |
| 4,4'-isopropylidenebis(2-methylphenol) | 136 |
| 4,4'-isopropylidenebis(2,6-dimethylphenol) | 168 |
| 4,4'-sec-butylidenediphenol | 119 |
| 4,4'-sec-butylidenebis(2-methylphenol) | 142 |
| 4,4'-cyclohexylidenediphenol | 180 |

-continued

| | Melting Point (°C.) |
|---|---|
| 4,4'-cyclohexylidenebis(2-methylphenol) | 184 |
| salicylic acid | 163 |
| salicylic acid m-tolyl ester | 74 |
| salicylic acid phenacyl ester | 110 |
| 4-hydroxybenzoic acid methyl ester | 131 |
| 4-hydroxybenzoic acid ethyl ester | 116 |
| 4-hydroxybenzoic acid propyl ester | 98 |
| 4-hydroxybenzoic acid isopropyl ester | 86 |
| 4-hydroxybenzoic acid butyl ester | 71 |
| 4-hydroxybenzoic acid isoamyl ester | 50 |
| 4-hydroxybenzoic acid phenyl ester | 178 |
| 4-hydroxybenzoic acid benzyl ester | 111 |
| 4-hydroxybenzoic acid cyclohexyl ester | 119 |
| 5-hydroxysalicylic acid | 200 |
| 5-chlorosalicylic acid | 172 |
| 3-chlorosalicylic acid | 178 |
| thiosalicylic acid | 164 |
| 2-chloro-5-nitrobenzoic acid | 165 |
| 4-methoxyphenol | 53 |
| 2-hydroxybenzyl alcohol | 87 |
| 2,5-dimethylphenol | 75 |
| benzoic acid | 122 |
| o-toluic acid | 107 |
| m-toluic acid | 111 |
| p-toluic acid | 181 |
| o-chlorobenzoic acid | 142 |
| m-hydroxybenzoic acid | 200 |
| 2,4-dihydroxyacetophenone | 97 |
| resorcinol monobenzoate | 135 |
| 4-hydroxybenzophenone | 133 |
| 2,4-dihydroxybenzophenone | 144 |
| 2-naphthoic acid | 184 |
| 1-hydroxy-2-naphthoic acid | 195 |
| 3,4-dihydroxybenzoic acid ethyl ester | 128 |
| 3,4-dihydroxybenzoic acid phenyl ester | 189 |
| 4-hydroxypropiophenone | 150 |
| salicylosalicylate | 148 |
| phthalic acid monobenzyl ester | 107 |

In the present invention, a porous filler can be contained in the acceptor layer or in the image transfer layer or in both of them. When the porous filler is contained in the acceptor layer, the thermally fused reaction components are readily transported from the image transfer layer to the acceptor layer, so that images are formed on the acceptor sheet. In the presence of the porous filler, even if the thermally fused reaction components transported from the image transfer layer to the acceptor layer are small in amount, the coloring reaction takes place sufficiently so that colored images with high density can be obtained.

It is preferable that the porous filler for use in the present invention have an oil absorption of 50 ml/100 g or more, more preferably 150 ml/100 g or more (measured in accordance with the Japanese Industrial Standard K 5101 method).

Specific examples of the porous filler are organic or inorganic powders, such as powders of silica, aluminum silicate, alumina, aluminum hydroxide, magnesium hydroxide, urea-formaldehyde resin and styrene resin. When the porous filler is contained in the acceptor layer, from the view point of the thermosensitivity and image density, it is preferable that the amount of the filler be in the range of 0.05 to 10 parts by weight, more preferably in the range of 0.1 part to 3 parts by weight, with respect to 1 part by weight of the coloring agent.

When the image transfer layer (i.e. the dye layer) and the acceptor layer (i.e. the coloring agent layer) are formed on each support material, the following binder agents can be employed: Water-soluble, organic-solvent-soluble, or aqueous-emulsion-forming binder agents, such as polyvinyl alcohol, methoxy cellulose, hydroxyethyl cellulose, carboxymethyl cellulose, polyvinylpyrrolidone, polyacrylamide, polyacrylic acid, starch, gelatin, polystyrene, vinyl chloride - vinyl acetate copolymer, and polybutylmethacrylate.

The thermosensitive image transfer medium according to the present invention can be prepared by dispersing or dissolving the above described components for each layer in a solvent such as water in a ball mill or in an attritor to prepare each layer formation liquid and by applying each layer formation liquid to each support material in an amount ranging from 0.3 to 30 g/m$^2$ (when dried).

In the image transfer sheet for use in the present invention, the image transfer layer can be formed uniformly on the entire surface of the support material or only in the necessary portions in the shape of image-like patterns on the support material. The image transfer layer formed uniformly on the entire surface of the support material can be formed by coating the image transfer layer formation liquid uniformly on the support material. The image transfer sheet having an image-like image transfer layer can be prepared by coating the image formation liquid on the surface of the support material by anastatic printing or by photogravure. Alternatively the image transfer sheet having such an image-like image transfer layer can be prepared by superimposing the transfer sheet having the uniform image transfer layer on an appropriate support material such as paper, synthetic paper, or plastic film and applying pressure in the corresponding image-like manner to the backside of the support material or to the backside of the image transfer sheet by use of pressure application means such as a typewriter or a steel pen or by use of heat application means such as a thermal head or thermal pen, whereby the image transfer layer is transferred in the form of image-like patterns from the image transfer sheet to the surface of the support material.

When thermal image transfer is conducted in the present invention, for example, by use of the image transfer sheet having the image-like image transfer layer, an acceptor sheet is superimposed on the surface of the image transfer layer, and the image transfer sheet and the acceptor sheet are caused to pass, for instance, between a pair of heat application rollers. When the image transfer sheet with the uniform image transfer layer is used, the acceptor sheet is superimposed on the image transfer sheet in such a manner that the acceptor layer is in close contact with the image transfer layer of the image transfer sheet, and direct thermal printing is conducted by use of a thermal printer on the backside of the image transfer sheet, or the acceptor sheet is superimposed on the image transfer sheet in the above-mentioned manner and a transparent original sheet having images written in black ink is further superimposed closely on the backside of the image transfer sheet and infrared rays are projected to the acceptor sheet, so that the black image portions of the original sheet are selectively heated to a high temperature, thus thermal image transfer is conducted corresponding to the images of the original sheet. In this case, it is necessary that the image transfer sheet and the acceptor sheet be transparent to infrared rays.

In the thermosensitive image transfer in the present invention, a number of copies can be made with ease by repeating the above described operation, using the same image transfer sheet. When making copies with multiple colors, a plurality of image transfer sheets, each of which contains a leuco dye capable of forming a different color from the colors of other leuco dyes, are prepared. For instance, an image transfer sheet containing a leuco dye which can be colored blue and another image transfer sheet containing a leuco dye which can be colored red are prepared. By superimposing those image transfer sheets successively on the same acceptor sheet, blue and red images can be formed on the same acceptor sheet.

In the present invention, the leuco dye and the coloring agent which induces color formation in the leuco dye are separately supported on different support materials. Therefore, no color fogging occurs during the preparation of the thermosensitive image transfer medium and the storage thereof, unlike the conventional thermosensitive sheets.

Further, in the copies made by the present invention, no leuco dye is present in the non-image areas of the copy sheets (i.e., the acceptor sheets), and only the coloring agent is present. Therefore, even if the copy sheet happens to be heated, no further coloring takes place. In other words, in the copies obtained by the present invention, image fixing is perfect. In addition to the above-mentioned advantage of the present invention, images with high density can be obtained by use of a small amount of thermal energy, a number of copies can be made from one image transfer sheet, and images formed on those copies are uniform in image density because a constant amount of the leuco dye is transferred from the image transfer layer of the image transfer sheet to the acceptor layer of the acceptor sheet during each image transfer step.

EXAMPLE 1

Preparation of Image Transfer Sheet A-1 and Image Transfer Sheet A-1 '.

The following components were dispersed in a ball mill for 24 hours to prepare an image transfer layer formation liquid. The thus prepared image transfer layer formation liquid was applied by a wire bar to a polyester film with a thickness of 12 μm whose surface was treated so as to be rough, with a deposition of the above solid components thereof in an amount of 10 g/m$^2$ when dried, whereby an image transfer sheet A-1 was prepared.

Crystal Violet Lactone: 20 g
N-stearylbenzamide: 20 g
Ethyl cellulose: 5 g
Water: 200 g The thus prepared image transfer sheet A-1 was superimposed on a sheet of high quality paper and image printing was performed on the backside of the high quality paper by a typewriter so that an image transfer layer was transferred to the high quality paper, in the shape of mirror images with respect to the typed images on the backside of the high quality paper, whereby an image transfer sheet A-1' having a mirror image-like image transfer layer was prepared.

Preparation of Acceptor Sheet B-1

The following components were dispersed in a ball mill for 24 hours to prepare an acceptor layer formation liquid. The thus prepared acceptor layer formation liquid was applied to a sheet of high quality paper (35 g/m$^2$) by a wire bar, with a deposition of the solid components thereof in an amount of 5 g/m$^2$ when dried, whereby an acceptor sheet B-1 was prepared.

4-hydroxybenzoic acid n-butyl ester: 20 g
Silica particles: 10 g
Polyvinyl alcohol: 3 g
Water: 100 g The image transfer sheet A-1' was superimposed on the acceptor sheet B-1 in such a manner that the mirror-image-like image transfer layer of the image transfer sheet A-1' was in close contact with the acceptor layer of the acceptor sheet B-1, and the superimposed image transfer sheet A-1' and the acceptor sheet B-1 were caused to pass through a pair of heat rollers so as to apply heat to the backside of the acceptor sheet B-1 at 95° C. As a result, blue images were formed on the acceptor sheet B-1. The image density of the thus obtained blue images was measured by use of a Macbeth densitometer (RD-514). The result is shown in Table 1.

From the first prepared image transfer sheet A-1, 10 image transfer sheets A-1' were made, using 10 sheets of the high quality paper successively. From those image transfer sheets A-1', 10 copies were made using 10 new acceptor sheets B-1. The images formed on those acceptor sheets were almost the same in image density in the first copy through the 10th copy.

EXAMPLE 2

In the formulation of the image transfer sheet A-1 in Example 1, N-stearylbenzamide was replaced by stearylacetamide, so that an image transfer sheet A-2 was prepared.

The thus prepared image transfer sheet A-2 was superimposed on a sheet of high quality paper, and image printing was performed on the backside of the high quality paper by a typewriter as in Example 1, whereby an image transfer sheet A-2' having a mirror-image-like image transfer layer was prepared.

The image transfer sheet A-2' was then superimposed on the acceptor sheet B-1 prepared in Example 1 in such a manner that the mirror-image-like image transfer layer of the image transfer sheet A-2' was in close contact with the acceptor layer of the acceptor sheet B-1, and the superimposed image transfer sheet A-2' and the acceptor sheet B-1 were caused to pass through a pair of heat rollers with application of heat thereto at 95° C. as in Example 1, whereby blue images were formed on the acceptor sheet B-1. The image density of the thus obtained blue images was measured by use of the Macbeth densitometer (RD-514) employed in Example 1. The result is shown in Table 1.

COMPARATIVE EXAMPLE 1

From the formulation of the image transfer sheet A-1 in Example 1, N-stearybenzamide was removed, whereby a comparative image transfer sheet CA-1 was prepared. As in Example 1, the thus prepared comparative image transfer sheet CA-1 was superimposed on a sheet of high quality paper and image printing was performed on the backside of the high quality paper by a typewriter so that a comparative image transfer sheet CA-1' having a mirror-image-like image transfer layer was prepared.

In exactly the same manner as in Example 1, the comparative image transfer sheet CA-1' was superimposed on the acceptor sheet B-1 and they were caused to pass through a pair of heat rollers with application of heat to the backside of the acceptor sheet B-1 at 95° C.

As a result, blue images were formed on the acceptor sheet B-1, and the image density of thus obtained blue images was measured by the Macbeth densitometer (RD-514). The result is shown in Table 1.

TABLE 1

| | Image Transfer Sheet | Acceptor Sheet | Image Density |
|---|---|---|---|
| Example 1 | A-1' | B-1 | 1.28 |
| Example 2 | A-2' | B-1 | 1.26 |
| Comparative Example 1 | CA-1' | B-1 | 0.98 |

EXAMPLE 3

Preparation of Image Transfer Sheet A-3 and Image Transfer Sheet A-3'

With respect to the preparation of an image transfer sheet, Example 1 was repeated except that the formulation of the image transfer sheet A-1 in Example 1 was changed to the following, whereby an image transfer sheet A-3 for formulation of red images was prepared.

3-diethylamino-6-chlorofluoran: 20 g
N-cyclohexylpropionamide: 20 g
Ethyl cellulose: 5 g
Water: 200 g The thus prepared image transfer sheet A-3 was superimposed on a sheet of high quality paper and image printing was performed on the backside of the high quality paper by a typewriter, so that an image transfer sheet A-3' having a mirror-image-like image transfer layer was prepared in the same manner as in Example 1.

The image transfer sheet A-3' was superimposed on the acceptor sheet B-1 on which a blue image was already formed by the same procedure as that in Example 1. The superimposed image transfer sheet A-3' and the acceptor sheet B-1 were caused to pass through a pair of heat rollers for application of heat to the backside of the image transfer sheet A-3' at 120° C. As the result, a clear red image was formed on the acceptor sheet B-1. Consequently, the red image and blue image were formed on the acceptor sheet B-1.

EXAMPLE 4

The image transfer sheet A-1 was superimposed on the acceptor sheet B-1, both of which were prepared in Example 1, in such a manner that the image transfer layer of the image transfer sheet A-1 was in close contact with the acceptor layer of the acceptor sheet B-1, and thermal printing was conducted on the backside of the image transfer sheet A-1 by use of a thermal printer having a thermal head. As a result, clear blue images were formed on the acceptor sheet B-1.

EXAMPLE 5

The image transfer sheet A-3 which was prepared in Example 3 for formation of red images was superimposed on the acceptor sheet B-1 on which a blue image was already formed by the same procedure as that in Example 4. As in Example 4, thermal printing was performed on the backside of the image transfer sheet A-3 by use of the thermal printer employed in Example 4. As a result, a clear red image was formed on the acceptor sheet B-1. Consequently, the red image and the blue image were formed on the acceptor sheet B-1.

EXAMPLE 6

Preparation of Image Transfer Sheet A-4 and Image Transfer Sheet A-4'

With respect to the preparation of an image transfer sheet, Example 1 was repeated except that the formulation of the image transfer sheet A-1 was changed to the following, whereby an image transfer sheet A-4 was prepared.

Crystal Violet Lactone: 20 g
4-hydroxybenzoic acid phenyl ester: 20 g
Ethyl cellulose: 5 g
Water: 200 g The thus prepared image transfer sheet A-4 was superimposed on a sheet of high quality paper and image printing was performed on the backside of the high quality paper by a typewriter, so that an image transfer sheet A-4' having a mirror-image-like image transfer layer was prepared.

Preparation of Acceptor Sheet B-2

The following components were dispersed in a ball mill for 24 hours to prepare an acceptor layer formation liquid. The thus prepared acceptor layer formation liquid were supplied to a sheet of high quality paper (35 g/m$^2$) by a wire bar, with a deposition of the solid components thereof in an amount of 3 g/m$^2$ when dried, whereby an acceptor sheet B-2 was prepared.

4-hydroxybenzoic acid n-butyl ester: 20 g
Polyvinyl alcohol: 3 g
Water: 100 g

In exactly the same manner as in Example 1, the image transfer sheet A-4' was superimposed on the acceptor sheet B-2 and they were caused to pass through a pair of heat rollers for application of heat to the backside of the acceptor sheet B-2 at 90° C. As the result, blue images were formed on the acceptor sheet B-2. The image density of the thus obtained blue images were measured by use of the Macbeth densitometer (RD-514). The result is shown in Table 2.

EXAMPLE 7

In the formulation of the image transfer sheet A-4 in Example 6, 4-hydroxybenzoic acid phenyl ester was replaced by benzoic acid-4-methoxydiphenyl ester, so that an image transfer sheet A-5 was prepared.

The thus prepared image transfer sheet A-5 was superimposed on a sheet of high quality paper and image printing was performed on the backside of the high quality paper by a typewriter as in Example 1, whereby an image transfer sheet A-5' having a mirror-image-like image transfer layer was prepared.

The image transfer sheet A-5' was then superimposed on the acceptor sheet B-2 prepared in Example 6 in such a manner that the mirror image-like image transfer layer of the image transfer sheet A-5' was in close contact with the acceptor layer of the acceptor sheet B-2 and they were caused to pass through a pair of heat rollers with application of heat to the backside of the acceptor sheet B-2 at 95° C., whereby blue images were formed on the acceptor sheet B-2. The image density of the thus obtained blue image was measured by use of the Macbeth densitometer (RD-514). The result is shown in Table 2.

COMPARATIVE EXAMPLE 2

From the formulation of the image transfer sheet A-4 in Example 6, 4-hydroxybenzoic acid phenyl ester was removed, whereby a comparative image transfer sheet CA-2 was prepared. As in Example 6, the thus prepared comparative image transfer sheet CA-2 was superimposed on a sheet of high quality paper and image printing was performed on the backside of the high quality paper by a typewriter so that a comparative image transfer sheet CA-2' having a mirror image-like image transfer layer was prepared.

In exactly the same manner as in Example 6, the comparative image transfer sheet CA-2' was superimposed on the acceptor sheet B-2 prepared in Example 6, and they were caused to pass through a pair of heat rollers with application of heat to the backside of the acceptor sheet B-2 at 95° C. As the result, blue images were formed on the acceptor sheet B-2. The image density of the thus obtained blue images was measured by the Macbeth densitometer (RD-514). The result is shown in Table 2.

TABLE 2

| | Image Transfer Sheet | Acceptor Sheet | Image Density |
|---|---|---|---|
| Example 6 | A-4' | B-2 | 1.12 |
| Example 7 | A-5' | B-2 | 1.15 |
| Comparative Example 2 | CA-2' | B-2 | 0.61 |

EXAMPLE 8

Preparation of Image Transfer Sheet A-6

The following components were dispersed in a ball mill for 24 hours to prepare an image transfer layer formation liquid. The thus prepared image transfer layer formation liquid was applied by a wire bar to a polyester film with a thickness of 12 μm whose surface was treated so as to be rough, with a deposition of the solid components thereof in an amount of 2 g/m$^2$ when dried, whereby an image transfer sheet A-6 was prepared.

3-N-methyl-N-cyclohexylamino-6-methyl-7-anilinofluoran: 15 g
4-benzoyloxybenzoic acid methyl ester: 20 g
Polyvinyl alcohol (10% aqeous solution): 20 g
Water: 200 g

Preparation of acceptor sheet B-3

The following components were dispersed in a ball mill for 24 hours to prepare an acceptor layer formation liquid. The thus prepared acceptor layer formation liquid was applied to a sheet of high quality paper (35 g/m$^2$) by a wire bar, with a deposition of the solid components thereof in an amount of 1.5 g/m$^2$ when dried, whereby an acceptor sheet B-3 was prepared.

4,4'-isopropylidenediphenol: 10 g
Salicylic acid (2-methoxyphenyl) ester: 10 g
Silica particles: 10 g
Methyl cellulose (5% aqueous solution): 20 g
Water: 200 g The image transfer sheet A-6 was superimposed on the acceptor sheet B-3 in such a manner that the image transfer layer of the image transfer sheet A-6 was in close contact with the acceptor layer of the acceptor sheet B-3, and thermal printing was performed on the backside of the image transfer sheet A-6 by use of the same thermal printer as that employed in Example 4. As a result, black images were formed on the acceptor sheet B-3. The image density of the thus obtained black images was measured by use of the Macbeth densitometer (RD-514). The result is shown in Table 3.

EXAMPLE 9

From the formulation of the image transfer sheet A-6 in Example 8, 4-benzoyloxybenzoic acid methyl ester was removed, whereby an image transfer sheet A-7* was prepared. With the image transfer sheet A-7* superimposed on the acceptor sheet B-3 prepared in Example 8, thermal printing was performed in the same manner as in Example 8. As a result, black images were formed on the acceptor sheet B-3. The image density of the black images is shown in Table 3.

EXAMPLE 10

From the formulation of the acceptor sheet B-3 in Example 8, salicylic acid (2-methoxyphenyl) ester was removed, whereby an acceptor sheet B-4* was prepared.

With the image transfer sheet A-6 prepared in Example 8 superimposed on the above prepared acceptor sheet B-4*, thermal printing was performed in the same manner as in Example 8 by use of the thermal printer. As the result, black images were formed on the acceptor sheet B-4*. The image density of the black images is shown in Table 3.

COMPARATIVE EXAMPLE 3

With the image transfer sheet A-7* prepared in Example 9 superimposed on the acceptor sheet B-4* prepared in Example 10, thermal printing was performed in the same manner as in Example 8 by use of the thermal printer. As the result, black images were formed on the acceptor sheet B-4*. The image density of the black images were measured by the Macbeth Densitometer and is shown in Table 3.

TABLE 3

| | Image Transfer Sheet | Acceptor Sheet | Image Density |
|---|---|---|---|
| Example 8 | A-6 | B-3 | 1.14 |
| Example 9 | A-7* | B-3 | 0.94 |
| Example 10 | A-6 | B-4* | 1.05 |
| Comparative Example 3 | A-7* | B-4* | 0.57 |

As can be seen from the results shown in Table 3, the thermosensitive image mediums according to the present invention provided higher image densities than the comparative example did. When the image transfer auxiliary agent is contained at least in the image transfer sheet, the image transfer auxiliary agent worked effectively, so that images with high image density were obtained.

EXAMPLE 11

Preparation of Image Transfer Sheet A-8 and Image Transfer Sheet A-8'

With respect to the preparation of an image transfer sheet, Example 6 was repeated except that the formulation of the image transfer sheet A-4 in Example 6 was changed to the following, whereby an image transfer sheet A-8 for formation of red images was prepared:

3-diethylamino-6-chlorofluoran: 20 g
Benzoic acid-4-benzylphenyl ester: 20 g

Ethyl cellulose: 5 g
Water: 200 g

In exactly the same manner as in Example 6, an image transfer sheet A-8′ having a mirror-image-like image transfer layer was prepared.

The image transfer sheet A-8′ was then superimposed on the acceptor sheet B-2 on which a blue image was already formed by the same procedure as in Example 6, and they were caused to pass through a pair of heat rollers for application of heat to the backside of the image transfer sheet B-2 at 105° C. As a result, a clear red image was formed on the acceptor sheet B-2. Consequently, the red image and the blue image were formed on the acceptor sheet B-2.

EXAMPLE 12

From the image transfer sheet A-4 prepared in Example 6, 10 image transfer sheets A-4′ were prepared in the same manner as in Example 6. From those image transfer sheets A-4′, 10 copies were made using 10 new acceptor sheets B-2. The images formed on those acceptor sheets were almost the same in image density in the first copy through the 10th copy.

What is claimed is:

1. A thermosensitive image transfer medium comprising:

an image transfer sheet having an image transfer layer which comprises as the main component a leuco dye; and an acceptor sheet having an acceptor layer which comprises as the main component a coloring agent, which coloring agent has a melting point of not higher than 200° C. and induces color formation in said leuco dye, and only one of said image transfer layer and said acceptor layer further contains at least one image transfer auxiliary agent for facilitating image formation selected from the group consisting of:

(1) N-substituted acid amides of the formula (I)

$$R^1NHCOR^2 \quad (I)$$

wherein $R^1$ represents an alkyl group having 10 to 30 carbon atoms, and $R^2$ represents an alkyl group having 1 to 30 carbon atoms;

(2) N-substituted acid amides of the formula (II)

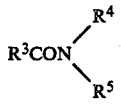

(II)

wherein $R^3$ represents an alkyl group having 10 to 30 carbon atoms, and $R^4$ and $R^5$ each represent hydrogen or a lower alkyl group;

(3) N-substituted acid amides of the formula (III)

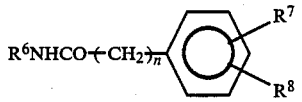

(III)

wherein $R^6$ represents an alkyl group having 1 to 30 carbon atoms, $R^7$ and $R^8$ each represent hydrogen, halogen, a lower alkyl group or a lower alkoxy group, and n is an integer of 0 or 1;

(4) N-substituted acid amides of the formula (IV)

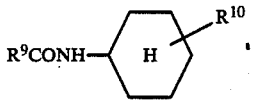

(IV)

wherein $R^9$ represents an alkyl group having 1 to 30 carbon atmos, or a substituted or unsubstituted aryl group, and $R^{10}$ represents hydrogen, halogen or a lower alkyl group;

(5) N-substituted acid amides of the formula (V)

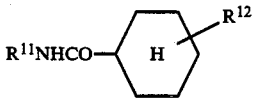

(V)

wherein $R^{11}$ represents an alkyl group or alkenyl group having 1 to 30 carbon atoms, and $R^{12}$ represents hydrogen, halogen or a lower alkyl group;

(6) esters of the formula (VI)

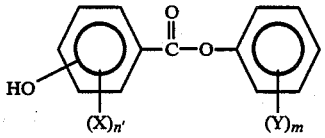

(VI)

wherein X represents halogen, and Y represents propenyl, an alkyl group or alkoxy group having 1 to 30 carbon atoms, halogen, a substituted or unsubstituted aryl group of aralkyl group, a substituted or unsubstituted aryloxy or aralkyloxy group, a carbosyl group or a hydroxyl group, n′ is an ingeter of 0, 1, 2 3 or 3; and m is an integer of 1, 2 or 3;

(7) esters of the formula (VII)

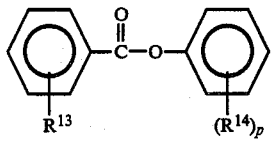

(VII)

wherein $R^{13}$ represents hydrogen, an alkyl group or alkoxy group having 1 to 30 carbon atoms, halogen, a nitro group, a nitrile group, an acyloxy group, a substituted or unsubstituted aryl group or aralkyl group, or a substituted or unsubstituted aryloxy or aralkyloxy group, $R^{14}$ represents hydrogen, an alkyl group of alkoxy group having 1 to 30 carbon atoms, halogen, a nitro group, a nitrile group, an acyloxy group, a substituted or unsubstituted aryl group or aralkyl group, a substituted or unsubstituted aryloxy group or aralkyloxy group, or an acyl group, and p is an integer of 1, 2, or 3; and (8) esters of the formula (VIII)

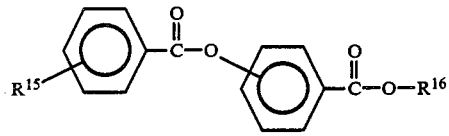

(VIII)

wherein $R^{15}$ represents hydrogen, an alkyl group or alkoxy group having 1 to 30 carbon atoms, or halogen, and $R^{16}$ represents an alkyl group or alkenyl group having 1 to 30 carbon atoms, or a substituted or unsubstituted aryl group or aralkyl group.

2. A thermosensitive image transfer medium as claimed in claim 1, wherein said image transfer auxiliary agent is employed in an amount in the range of 0.1 to 50 parts by weight to 1 part by weight of said leuco dye.

3. A thermosensitive image transfer medium as claimed in claim 1, wherein said leuco dye is selected from the group consisting of triphenylmethane-type leuo dyes, fluoran-type leuco dyes, phenothiazine-type leuco dyes, auramine-type leuco dyes and spiropyran-type leuco dyes.

4. A thermosensitive image transfer medium as claimed in claim 1, wherein said image transfer sheet and said acceptor sheet each further comprise a support on which said image transfer layer and said acceptor layer are respectively supported.

5. A thermosensitive image transfer medium as claimed in claim 4, wherein the coating amount of said leuco dye on said support material associated with said image transfer sheet is in the range of 0.3 $g/m^2$ to 50 $g/m^2$.

6. A thermosensitive image transfer medium as claimed in claim 1, wherein said coloring agent is an electron acceptor material.

7. A thermosensitive transfer medium as claimed in claim 5, wherein said electron acceptor material is selected from the group consisting of phenolic materials other than organic acids, esters, and acid salts, organic acids, organic acid salts, and organic acid esters.

8. A thermosensitive image transfer medium as claimed in claim 1, wherein, of said image transfer layer and said acceptor layer, at least said acceptor layer further contains a porous filler having an oil absorption of 50 ml/100 g or more as measured in accordance with the method of Japanese Industrial Standard K 5101.

9. A thermosensitive image transfer medium as claimed in claim 8, wherein the amount of said porous filler is in the range of 0.05 to 10 parts by weight to 1 part by weight of said coloring agent.

10. A thermosensitive image transfer medium as claimed in claim 9, wherein said filler is selected from the group consisting of silica particles, aluminum silicate particles, alumina particles, aluminum hydroxide particles, magnesium hydroxide particles, urea-formaldehyde resin particles and styrene resin particles.

11. A thermosensitive image transfer medium as claimed in claim 1, wherein said coloring agent is different from said image transfer auxiliary agent.

12. A thermosensitive image transfer medium as claimed in claim 11, wherein said image transfer auxiliary agent is selected from the group consisting of said N-substituted acid amides (1) and said N-substituted acide amides (2).

13. A thermosensitive image transfer medium as claimed in claim 11, wherein said image transfer auxiliary agent is selected from the group consisting of said N-substituted acid amides (3).

14. A thermosensitive image transfer medium as claimed in claim 11, wherein said image transfer auxiliary agent is selected from the group consisting of said N-substituted acid amides (4) and said N-substituted acid amides (5).

15. A thermosensitive image transfer medium as claimed in claim 11, wherein said image transfer auxiliary agent is selected from the group consisting of said esters (6) and said esters (7).

16. A thermosensitive image transfer medium as claimed in claim 11, wherein said image transfer auxiliary agent is selected from the group consisting of said esters (8).

17. A thermosensitive image transfer medium comprising:

an image transfer sheet comprising a first support having an image transfer layer thereon, said image transfer layer consisting essentially of (a) from 0.3 to 50 grams of leuco dye per square meter of said first support, (b) from 0.1 to 50 parts by weight of image transfer auxiliary agent per 1 part by weight of said leuco dye, and (c) first binder agent; and an acceptor sheet comprising a second support having an acceptor layer thereon, said acceptor layer consisting essentially of (d) coloring agent having a melting point of not higher than 200° C. and selected from the group consisting of phenolic compounds, organic carboxylic acids and esters and salts thereof, which coloring agent can react with said leuco dye to color said dye when said acceptor layer is heated while in contact with said image transfer layer, and (e) second binder agent, said image transfer auxiliary agent being effective for facilitating image formation and being selected from the group consisting of:

(1) N-substituted acid amides of the formula (I)

$$R^1NHCOR^2 \quad (I)$$

wherein $R^1$ represents an alkyl group having 10 to 30 carbon atoms, and $R^2$ represents an alkyl group having 1 to 30 carbon atoms;

(2) N-substituted acids amides of the formula (II)

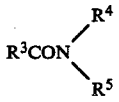

(II)

wherein $R^3$ represents an alkyl group having 10 to 30 carbon atoms, and $R^4$ and $R^5$ each represent hydrogen or a lower alkyl group;

(3) N-substituted acid amides of the formula (III)

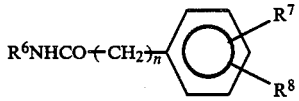

(III)

wherein $R^6$ represents an alkyl group having 1 to 30 carbon atoms, $R^7$ and $R^8$ each represent hydrogen, halogen, a lower alkyl group or a lower alkoxy group, and n is an integer of 0 to 1;

(4) N-substituted acid amides of the formula (IV)

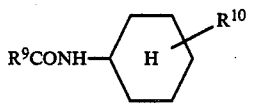

(IV)

wherein $R^9$ represents an alkyl group having 1 to 30 carbon atoms, or a substituted or unsubstituted aryl group, and $R^{10}$ represents hydrogen, halogen or a lower alkyl group; and (5) N-substituted acid amides of the formula (V)

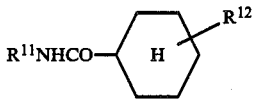

(V)

wherein $R^{11}$ represents an alkyl group or alkenyl group having 1 to 30 carbon atoms, and $R^{12}$ represents hydrogen, halogen or a lower alkyl group;

whereby when an assembly is formed of said acceptor sheet with said image transfer sheet in which said acceptor layer is in face-to-face contact with said image transfer layer and heat is applied in an imagewise pattern on either said first support or said second support, said image transfer auxiliary agent lowers the melting point of said image transfer layer to permit imagewise transfer of small amounts of said leuco dye from said image transfer layer to said acceptor layer and a color-forming reaction will occur in said acceptor layer to form a corresponding image on said acceptor layer, said acceptor sheet then being separable from said image transfer sheet to provide a copied image and said image transfer sheet being capable of repeated use with other like acceptor sheets.

* * * * *

UNITED STATES PATENT AND TRADEMARK OFFICE

CERTIFICATE OF CORRECTION

PATENT NO. : 4 575 734

DATED : March 11, 1986

INVENTOR(S) : Norio Kurisu et al

It is certified that error appears in the above-identified patent and that said Letters Patent is hereby corrected as shown below:

Column 18, line 40; change "carbosyl" to ---carboxyl---.
line 41; change "ingeter of 0, 1, 2 3 or 3;" to ---integer of 0, 1, 2 or 3;"---.

Signed and Sealed this

*Nineteenth* Day of *August 1986*

[SEAL]

*Attest:*

DONALD J. QUIGG

*Attesting Officer*

*Commissioner of Patents and Trademarks*